US007025223B2

(12) United States Patent
Hamm

(10) Patent No.: US 7,025,223 B2
(45) Date of Patent: Apr. 11, 2006

(54) GRID CASING FOR A CONTAINER

(75) Inventor: André Hamm, Drulingen (FR)

(73) Assignee: Roth Werke GmbH, Dautphetal (DE)

( * ) Notice: Subject to any disclaimer, the term of this patent is extended or adjusted under 35 U.S.C. 154(b) by 192 days.

(21) Appl. No.: 10/279,561

(22) Filed: Oct. 24, 2002

(65) Prior Publication Data

US 2003/0085229 A1 May 8, 2003

(30) Foreign Application Priority Data

Nov. 6, 2001 (DE) ..... 101 54 388

(51) Int. Cl.
*B65D 6/08* (2006.01)

(52) U.S. Cl. ..... 220/485; 220/1.5; 206/386

(58) Field of Classification Search ..... 220/485, 220/1.5–1.6, 23.91; 206/386
See application file for complete search history.

(56) References Cited

U.S. PATENT DOCUMENTS

| | | | | |
|---|---|---|---|---|
| 2,733,828 A | | 2/1956 | Averill | |
| 4,795,057 A | * | 1/1989 | Jungels et al. | 206/386 |
| 4,909,387 A | * | 3/1990 | Schutz | 206/386 |
| 4,966,293 A | * | 10/1990 | Pfeiffer et al. | 220/1.5 |
| 6,050,437 A | | 4/2000 | Schütz | |

FOREIGN PATENT DOCUMENTS

| | | | |
|---|---|---|---|
| DE | 3442701 | | 5/1988 |
| DE | 3728965 | | 3/1989 |
| DE | 195 03 043 | * | 8/1996 |
| DE | 196 42 242 | * | 3/1998 |
| DE | 10002610 | | 8/2001 |
| DE | 10038466 | | 2/2002 |
| EP | 1055613 | | 11/2000 |
| FR | 2523078 | | 9/1983 |
| FR | 2728238 | | 6/1996 |
| WO | WO 98/12124 | * | 3/1998 |

* cited by examiner

*Primary Examiner*—Jes F. Pascua
(74) *Attorney, Agent, or Firm*—Friedrich Kueffner

(57) ABSTRACT

A grid casing for a container having a tendency to become electrostatically charged has a basic grid made of basic grid bars forming a basic grid mesh structure. The basic grid is primarily responsible for the strength of the grid casing. Additional grid bars are provided for forming a tighter grid mesh structure relative to the basic grid mesh structure of the basic grid.

8 Claims, 3 Drawing Sheets

GRID CASING FOR A CONTAINER

BACKGROUND OF THE INVENTION

1. Field of the Invention

The invention relates to a grid casing for a container having a tendency to become electrostatically charged, in particular, for a pallet container comprising an inner container of plastic material.

2. Description of the Related Art

The voluminous inner containers of pallet containers, usually manufactured of polyethylene, have a tendency to become electrostatically charged. Inter alia, when the liquid contained in the container moves, friction on the container wall can cause electric charges which cannot dissipate on the insulating material. In this way, great potential differences relative to the grid casing can result and, finally, spark discharge may occur. When employing the containers as a receptacle for flammable liquids, a fire or even explosion hazard is present.

SUMMARY OF THE INVENTION

It is an object of the present invention to provide a novel grid casing which eliminates the fire and explosion hazard which is present in regard to containers having a tendency to become electrostatically charged when using the container for flammable liquids.

In accordance with the present invention, this is achieved by a basic grid primarily responsible for the strength of the grid casing as well as additional grid bars for forming a secondary grid mesh structure which is tighter than the basic grid mesh structure of the basic grid.

According to the invention, a bearing grid casing which enables stacking of pallet containers is supplemented with additional grid bars. In this way, a grid having a tight enough secondary grid mesh structure can be formed by which the maximum distance between a location of the wall of the inner container and the conductor which is formed by the grid is so minimal that high electrical potentials or high electrical field strengths leading to spark discharge are prevented and, in this way, a neutralization of the electrical charges formed on the container wall is ensured.

The basic grid alone can be responsible for the strength of the grid casing. On the other hand, the additional grid bars can contribute to the strength of the grid casing. In this case, the basic grid can be made weaker accordingly, saving material and reducing weight in this way.

While it is conceivable to form, by means of additional grid bars, a complete, sufficiently tight substructure grid, for example, of crossing substructure grid bars, according to the preferred embodiment of the intention the additional grid bars provide a tighter secondary grid mesh structure together with the basic grid bars of the basic grid. In this way, weight and material are saved.

In one embodiment of the invention, an additional substructure grid could be simply suspended in the basic grid. However, the additional grid bars preferably form together with the basic grid bars of the basic grid a unit in that they are connected with these basic grid bars, in particular, by welding.

Expediently, the basic grid bars of the basic grid have a hat-shaped profile and are connected by welding to one another at the crossing points by means of the rims of the hat-shaped profiles. Also, the additional grid bars can be welded to the basic grid bars of the basic grid by means of these rims, wherein the additional grid bars can extend parallel to the vertical basic grid bars of the basic grid or/and the horizontal basic grid bars of the basic grid.

When using basic grid bars having a hat-shaped profile, the ends of the bars of the additional grid bars can be expediently bent into the hat-shaped profile so that these ends of the bars do not constitute a hazard with regard to injuries.

The grid casing can be efficiently produced by bending a grid web which comprises, in addition to the basic grid, already the additional grid bars welded to the bars of the basic grid.

DESCRIPTION OF THE PREFERRED EMBODIMENTS

Vertical grid walls 2 to 5 extend upwardly from a sheet metal bottom 1 of a metal grid casing, wherein the walls 2 to 5 are formed by bending a grid web multiple times. The sheet metal bottom 1 is matched in regard to its shape to the inner plastic container (not illustrated) to be received in the grid casing and can be connected to a pallet (not illustrated).

The grid walls 2 to 5 comprise a basic grid of crossing basic grid bars 6 and 7 wherein the basic grid bars 6 extend horizontally and the basic grid bars 7 extend vertically.

Figure 4:
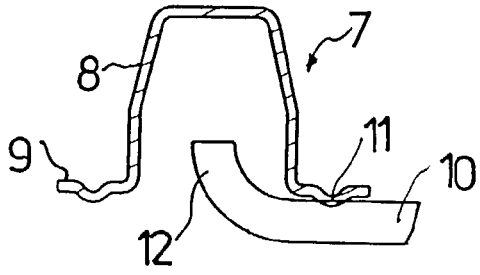
FIG. 4 shows a detail of the grid casing of FIGS. 1 through 3.

As illustrated in particular in FIG. 4, the basic grid bars of the basic grid have a hat-shaped profile 8 with rims 9.

By means of the rims 9, the crossing basic grid bars 6 and 7 are welded together at their crossing locations. The hat-shaped profile of the vertical basic grid bars 7 open toward the exterior of the grid casing while the open side of the hat-shaped profile of the horizontal basic grid bars 6 open to the interior of the casing in the illustrated embodiment.

In addition to the horizontal basic grid bars 6 of the basic grid, additional grid bars 10 of a circular cross-section are provided whose bearing capacity is minimal in comparison to the bearing capacity of the basic grid bars 6 and 7 of the basic grid.

The grid bars 10, like the basic grid bars 6 of the basic grid, are formed by a bar extending about the circumference of the grid casing wherein the ends 12 of the bar according to FIG. 4 are bent into the hat-shaped profile of a vertical grid bar 7. The horizontally extending additional grid bars 10 are welded to the rims 9 of the hat-shaped profile 8 of the vertical basic grid bars 7, as illustrated at 11 in FIG. 4.

The grid walls 2 to 5 are connected by means of the vertical basic grid bars 7 with the sheet metal bottom. An upper end portion of the grid walls is formed by an annular support 13 connected to the upper ends of the vertical basic grid bars 7. The annular support 13 is assembled of round bars 14 and bent or angled connecting parts 15.

Figure 2:
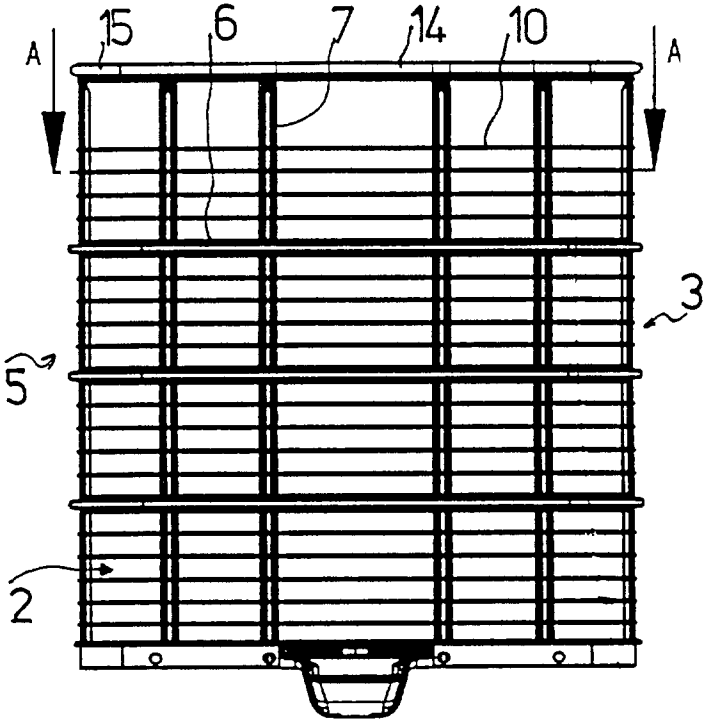
FIG. 2 shows the grid casing of FIG. 1 in a side view.
Figure 1:
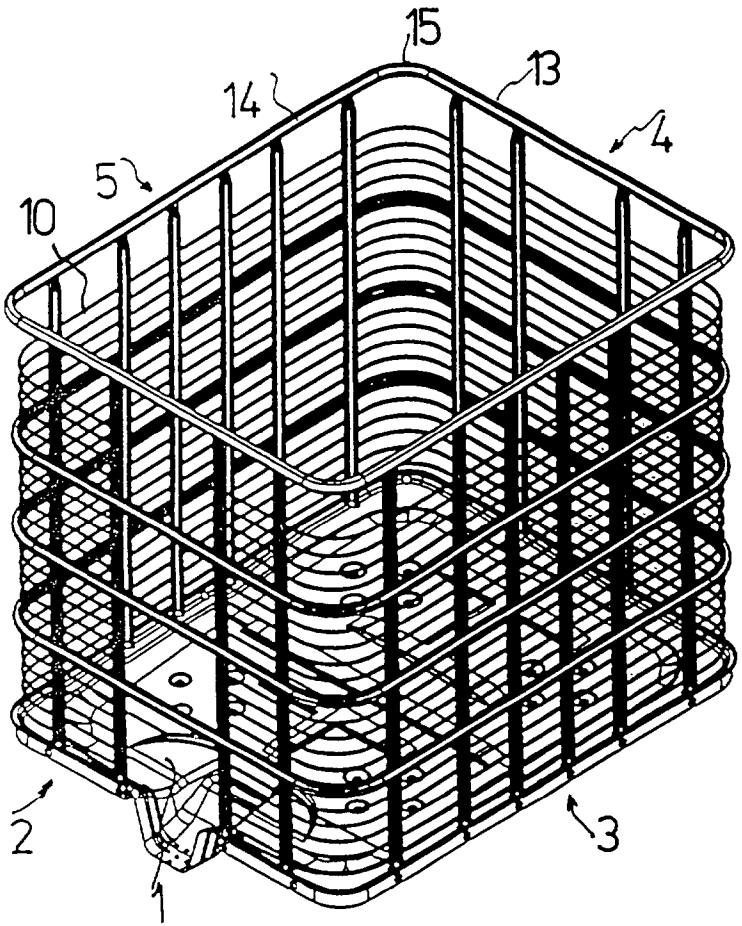
FIG. 1 is a first embodiment of a grid casing according to the invention in a perspective view.
Figure 5:
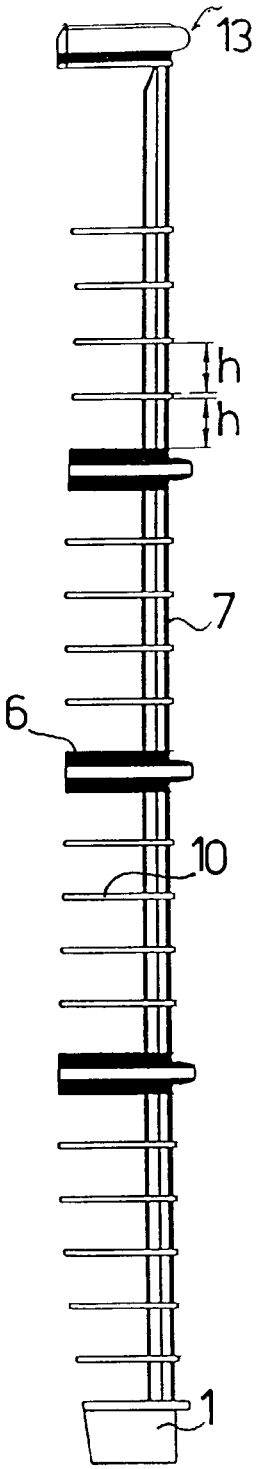
FIG. 5 shows an additional detail of the grid casing of FIGS. 1 through 3.
Figure 3:
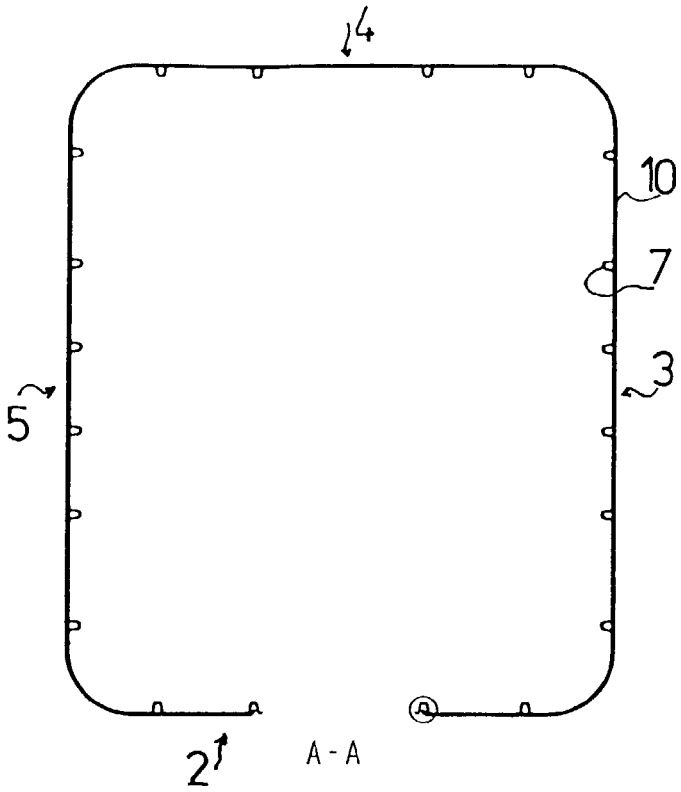
FIG. 3 shows the grid casing of FIGS. 1 and 2 in a cross-sectional top view.

The additional grid bars 10 and the horizontal basic grid bars 6 form together with the vertical basic grid bars 7 of the basic grid a rectangular secondary grid mesh structure with identical mesh height h (see FIG. 5). This mesh height h is so small that the spacing to the surface of the inner container at any location is so small that electrostatic charges on the inner container can be neutralized via the grid casing.

Figure 6:
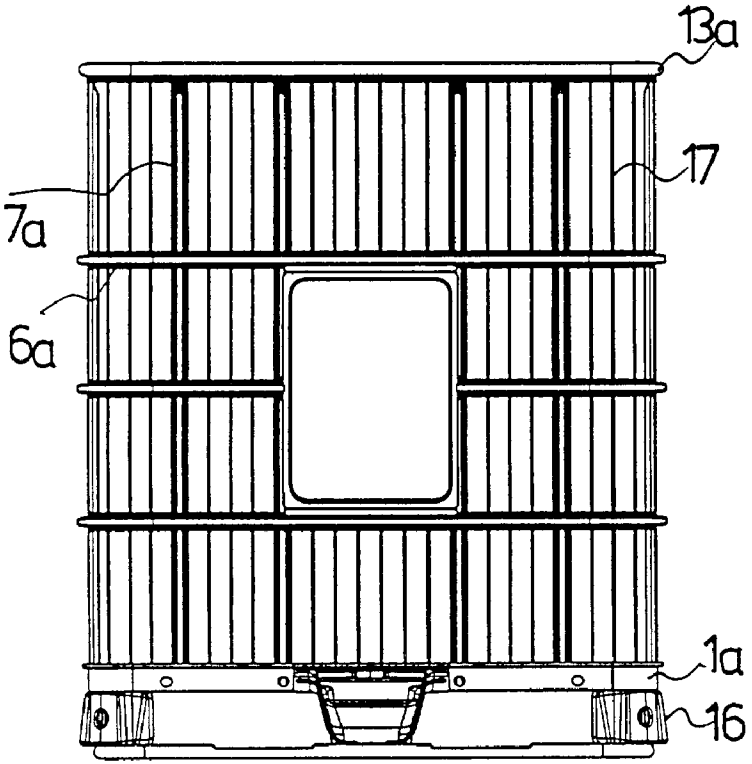
FIG. 6 shows a second embodiment of a grid casing according to the invention.

FIG. 6 shows an embodiment for a grid casing which is connected to a pallet 16. In contrast to the grid casing according to FIGS. 1 to 4, the grid casing of FIG. 6 has vertically extending additional grid bars 17 whose lower ends are connected to the sheet metal bottom 1*a* of the grid casing and whose upper ends are connected to an annular support 13*a* of the grid casing. Moreover, the grid bars 17 are connected to the horizontal basic grid bars 6*a* as well as the vertical basic grid bars 7*a* forming together the basic grid wherein a welding connection is again provided at the rims of the hat-shaped profile forming the basic grid bars, as illustrated in FIG. 4.

The embodiment illustrated in FIG. 6 shows that the horizontal width of all of the grid meshes is identical and so minimal that a neutralization of electrostatic charges present on the inner container is possible.

Figure 7:
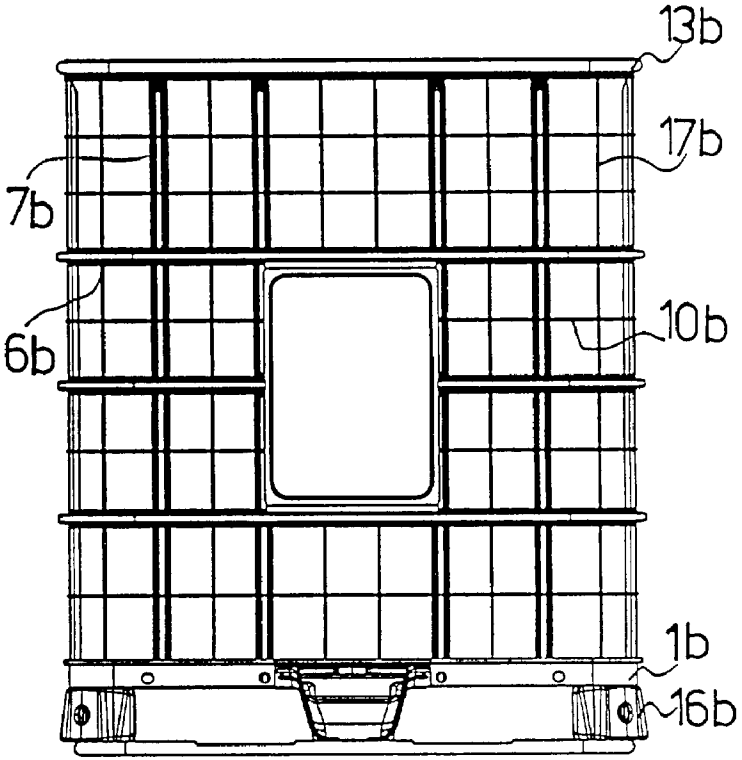
FIG. 7 shows a third embodiment of a grid casing according to the invention.

FIG. 7 shows an embodiment in which, in addition to a basic grid of crossing basic grid bars 6*b* and 7*b*, additional horizontal as well as additional vertical grid bars 10*b* and 17*b* are provided. The mesh width of the meshes which are formed partially by the additional grid bars and commonly by the additional grid bars and the basic grid bars of the basic grid, is so minimal everywhere that a neutralization of electrostatic charge of the inner container can be realized.

In the areas of the front side of the grid casing, which areas are free of additional grid bars, as well as at the topside of the grid casing, measures for charge neutralization are provided which are independent of the configuration of the grid casing.

While specific embodiments of the invention have been shown and described in detail to illustrate the inventive principles, it will be understood that the invention may be embodied otherwise without departing from such principles.

What is claimed is:

1. A grid casing for a container having a tendency to become electrostatically charged, the grid casing comprising:

a basic grid comprised of vertically and horizontally extending basic grid bars forming a basic grid mesh structure and only responsible for a strength of the grid casing; and additional grid bars for forming a secondary grid mesh structure that is tighter than the basic grid mesh structure of the basic grid, the additional grid bars being welded to the basic grid bars, having a bearing capacity that is minimal compared to a bearing capacity of the basic grid bars, wherein the additional grid bars form together with the basic grid bars the secondary grid mesh structure, the mesh having at least one of a height and a width small enough that electrostatic charges on the inner container are neutralizable via the grid casing.

2. The grid casing according to claim 1, configured for a pallet container with an inner container of plastic material.

3. The grid casing according to claim 1, wherein the basic grid alone is responsible for the strength of the grid casing.

4. The grid casing according to claim 1, wherein the additional grid bars contribute to the strength of the basic grid.

5. The grid casing according to claim 1, wherein the basic grid bars of the basic grid have a hat-shaped profile with rims and are connected to one another at crossing locations at the rims of the hat-shaped profiles.

6. The grid casing according to claim 5, wherein the additional grid bars are connected to the basic grid bars of the basic grid at the rims of the hat-shaped profiles.

7. The grid casing according to claim 5, wherein the additional grid bars have ends bent into the hat-shaped profile of the basic grid bars, respectively.

8. The grid casing according to claim 1, wherein the basic grid bars and the additional grid bars initially form a grid web and wherein the grid web is bent to form the grid casing.

* * * * *